United States Patent [19]

Belliveau

[11] Patent Number: 4,826,100

[45] Date of Patent: May 2, 1989

[54] DEVICE FOR USE IN UNWINDING OR REWINDING COILED ELECTRICAL WIRE

[76] Inventor: Robert C. Belliveau, 240 Millbury Ave., Millbury, Mass. 01527

[21] Appl. No.: 142,492

[22] Filed: Jan. 11, 1988

[51] Int. Cl.[4] ..... B65H 49/28

[52] U.S. Cl. ..... 242/129; 242/85

[58] Field of Search ..... 242/129, 54 R, 85, 86, 242/105, 78.6

[56] References Cited

U.S. PATENT DOCUMENTS

| | | | |
|---|---|---|---|
| 1,147,680 | 7/1915 | Crawford | 242/129 |
| 2,197,767 | 4/1940 | Neale | 242/86 |
| 2,300,243 | 10/1942 | Zierden | 242/86 |
| 2,562,650 | 7/1951 | Trunkhill | 242/129 |
| 3,464,647 | 9/1969 | Jacobi | 242/129 |
| 3,729,092 | 4/1973 | Marcell | 242/129 X |
| 3,837,597 | 9/1974 | Bourhenne | 242/129 |
| 4,015,795 | 4/1977 | Chong | 242/129 X |
| 4,089,486 | 5/1978 | Carter | 242/129 |
| 4,471,921 | 9/1984 | Corbin | 242/129 |
| 4,667,897 | 5/1987 | Burrow et al. | 242/129 |

*Primary Examiner*—Stanley N. Gilreath

*Attorney, Agent, or Firm*—Irving M. Kriegsman

[57] ABSTRACT

A device for use in assisting a person in unwinding or re-winding coil wire includes a base adapted to rest on a horizontal surface and a coil holder rotatably mounted on the base and sized to accommodate the coil wire. The coil holder has a disc having a top surface and a bottom surface. A wire guide projects upward from the top surface of the coil holder and an axle having a circular flange projects downward from a boss on the bottom surface. The base includes a mounting hole into which the axle of the disc is inserted until the boss rests upon the base. The base also includes a barrier which is generally cylindrically shape and which is situated so as to prevent the wire from becoming caught between the disc and the base as it is being unwound or rewound. To unwind coil wire, a user places the coil on the top surface of the coil holder in such a way as to encircle the wire guide. The user then puts an end of the wire through a hole in the barrier and pulls on the end of wire causing the disc to rotate and the wire to become unwound. To re-wind the unwound wire, the user simply rotates the disc in the opposite direction. As the disc rotates, the wire re-wraps around the wire guide.

4 Claims, 4 Drawing Sheets

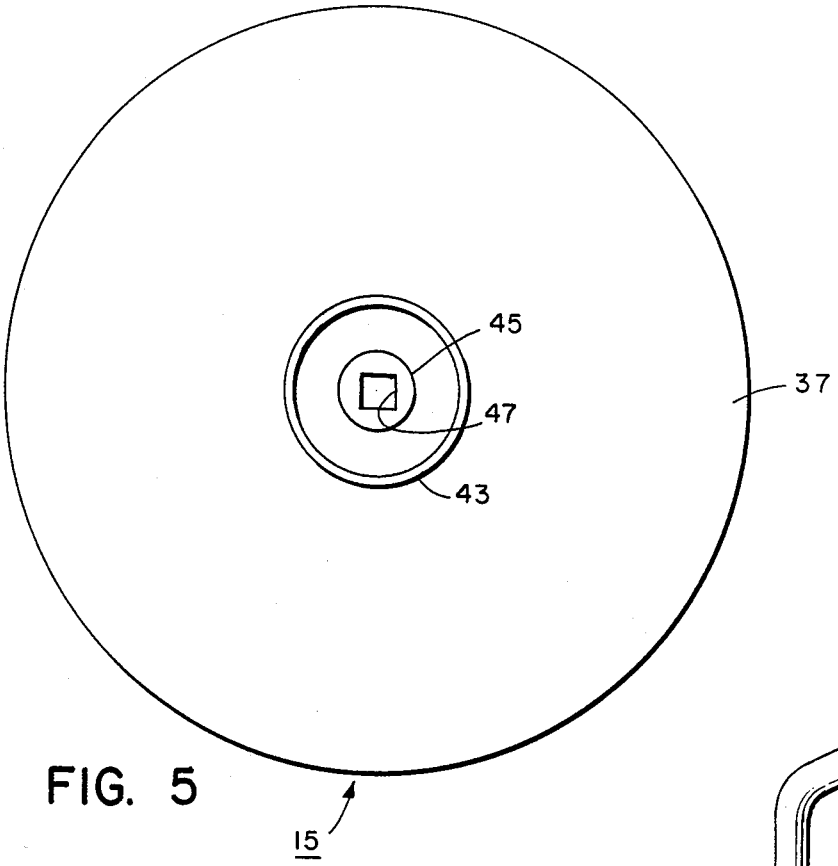
FIG. 5
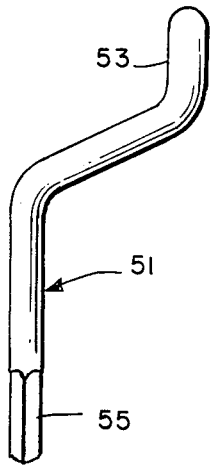
FIG. 6
FIG. 7
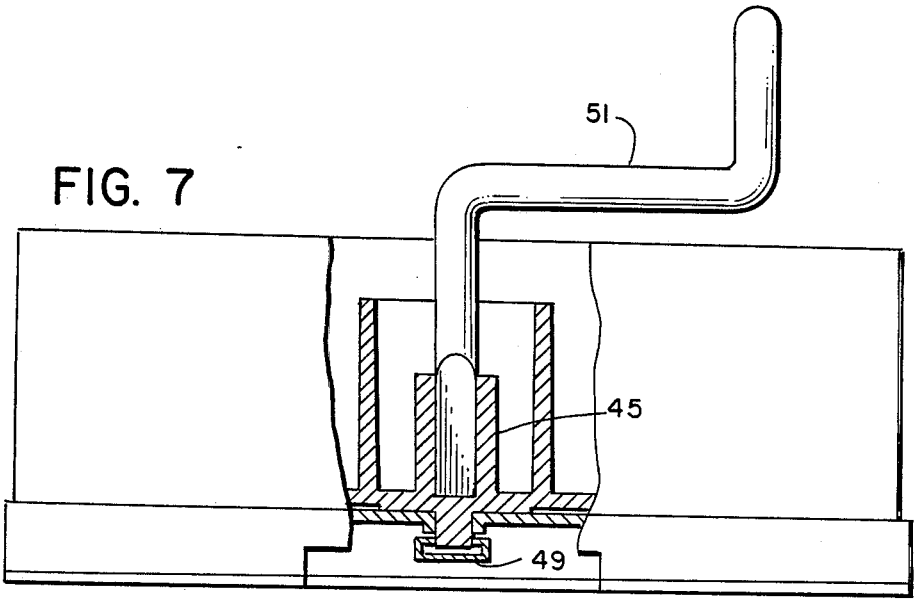

DEVICE FOR USE IN UNWINDING OR REWINDING COILED ELECTRICAL WIRE

BACKGROUND OF THE INVENTION

The present invention relates generally to coiled electrical wire and, more particularly, to a device for use in unwinding a re-winding a length of coiled electrical wire.

Electrical wire used in the rough free wire construction of residential and commercial buildings is available for use either wound on reels or wound in a coiled configuration. To remove a length of wire that is wound on a reel, an electrician will usually mount the reel on some type of a holder so that it can rotate and then pull the wire from one end. Because the reel is rotatably mounted, as the electrician pulls on the end of the wire, the reel will rotate causing the wire to unwind from the reel in a relatively straight (i.e. not spiraled) configuration. As one can well imagine, electricians prefer to work with wire that is straight rather than spiraled because, in the course of installation, spiraled wire will very often get tangled as it is being threaded through very narrow holes or around beams or other obstructions.

Despite the fact that wire on reels unwinds straight, most electricians choose not to use the wire on reels because it comes in larger lengths than coiled wire, is heavier and more bulky to handle than coiled wire and is often more expensive. Instead, most electricians use coiled wire (also referred to as Romex or boxed coils). The problem with coiled wire is that, unlike wire on reels, there is no quick and easy way to straighten out the wire as it is being unwound. If the electrician simply reaches into the box holding the coil and pulls out a length, i.e. a handful of coils or turns, the portion grasped will remain coiled (i.e. spiraled) when it is let loose and will not become straight. Because, as noted above, coiled wire is not very desirable for use when in a spiraled form, the electrician must in one way or another manually unspiral the wire so that it is straight, a few turns at a time, usually by straightening each turn as it is being unwound. As can be appreciated, this process is cumbersome and extremely time consuming.

Another problem associated with using coiled wire, as compared to wire on reels, is that of re-winding a length of wire that has already been unwound for storage or other like purposes. With reels, the electrician rewinds the unwound wire by simply rotating the reel in the direction opposite to the direction used to unwind the wire. In contrast, the electrician who wishes to rewind a length of unwound and straight coiled wire must manually deform the wire into loops of diameters comparable to those that originally existed and then in some way stack them one on top of the other and then place the stack of coils in a box or other container.

Accordingly, it is an object of the present invention to provide a device for use in assisting a person in unwinding or re-winding coiled electrical wire.

It is another object of the present invention to provide a device for use in assisting a person in unwinding or re-winding coil wire which is easy to manufacture.

It is still another object of the present invention to provide a device for use in assisting a person in unwinding or re-winding coil wire which can be mass produced.

It is yet another object of the present invention to provide a device for use in assisting a person in unwinding or re-winding coil wire which is easy to operate.

It is a further object of the present invention to provide a device for use in assisting a person in unwinding or re-winding coil wire which has a minimal number of parts, which is easy to assemble, which is easy to use and which is portable.

SUMMARY

A device for use in assisting a person in unwinding or re-winding a length of coil wire constructed according to the teachings of the present invention comprises a base adapted to rest on a horizontal surface such as a floor and a coil holder rotatably mounted on the base and on which the coil wire to be unwound may be placed.

In use the coil to be unwound is removed from the box and placed on top of the coil holder. As the user pulls the wire from one end, the weight of the wire on the coil holder will cause the coil holder to rotate relative to the base carrying the coiled wire with it, thereby causing the wire to unwind into a straight as opposed to spiraled configuration.

Various features and advantages will appear from the description to follow. In the description, reference is made to the accompanying drawing which forms a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

In the drawings wherein like reference numerals represent like parts:

FIG. 1(*a*) is a section view of the coil holder in the device shown in FIG. 1;

FIG. 1(*b*) is a section view of the base in the device shown in FIG. 1;

FIG. 5 is a plan view of the coil holder shown in FIG. 1;

FIG. 6 is an enlarged perspective view of the crank re-winder for use with the device shown in FIG. 1; and FIG. 7 is a front elevation view partly in section of the device shown in FIG. 1 with the crank re-winder of FIG. 6 inserted therein for use.

DETAILED DESCRIPTION OF A PREFERRED EMBODIMENT

Figure 1:
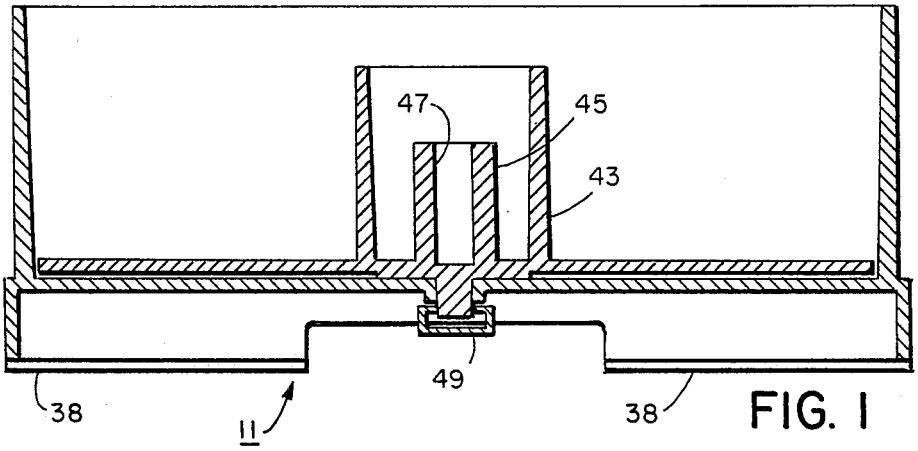
FIG. 1 is a front section view of a device for use in assisting a person in unwinding or re-winding coil wire constructed according to the teachings of the present invention.

Referring now to the drawings, there is illustrated a device for use in assisting a person in unwinding or re-winding coil wire constructed according to the teachings of the present invention and represented generally by reference numeral 11.

Device 11 includes a base 13 and a coil holder 15. Coil holder 15 is rotatably mounted on base 13.

Base 13 is a unitary structure, made of a rigid plastic material, such as Baydoor 726, which is suitable for durable molding or other similar material. Base 13 is molded so as to form a generally rectangularly shaped structure having a top wall 19 and a set of four side walls 21-1 through 21-4. Top wall 19 has a centrally located mounting hole 23, which is circular in shape, and an oval shaped slot 25 which serves as a handle. Side wall 21-1, which is next to slot 25, includes a cut out area 27 so that a hand of a user can be inserted through slot 25 and then up through area 27 when it is desired to move device 11 from one location to another. A cylindrical wall 29 which serves as a barrier extends up from top wall 19 and is concentric about mounting hole 23. Wall 29 comprises a straight outer surface 31 and an inner surface 33 which may be slightly sloping. The inside diameter of wall 29 is many times greater than that of mounting hole 23. A wire passage hole 35 is formed on wall 29.

Rubber gripping strips 38 are fixedly attached to the bottom of base 13 to prevent movement of base 13 when device 11 is seated on a surface and being used.

Coil holder 15 is also a unitary structure made of a rigid plastic, such as Baydoor 726 or any other plastic material similarly suitable for durable molding or other similar material. Coil holder 15 includes a main disc shaped portion 37 having a diameter which is greater than that of hole 23 and less than but no more than ¼ inch smaller than that of barrier 29. Projecting downward from the center of disc shaped portion 37 is an axis 39. Axle 39 has a diameter which is slightly smaller than that of mounting hole 23 and extends downward from a boss portion 41 on the bottom of disc shaped portion 37. Boss 41 serves to slightly elevate disc portion 37 relative to base 13 when axle 39 is inserted into hole 23. By elevating disc portion 37, boss 41 reduces the friction that impedes the rotation of disc 15. A hollow cylindrically shaped integrally formed wall 43 which functions as a wire guide extends upward from top surface of disc shaped portion 37. Finally, a boss 45 having a handle receiving square hole 47 extends up from disc shaped portion 37. Square hole 47, which will also be further described later, is also used to manually turn coil holder 15, when desired, in order to re-wind partially unwound coil wire or even to help in unwinding wire from the coil.

Coil holder 15 is removably secured to base 13 by a clip ring 49. Clip ring 49 may be made of metal, plastic, or any other similarly suitable material.

To assemble device 11, the user first inserts axle 39 of coil holder 15 into hole 23 of top wall 19 until boss 41 rests against top wall 19. Then, clip ring 49 is attached to axle 39. Coil holder 15 is now fixedly and rotatably mounted on base 13.

Figure 3:
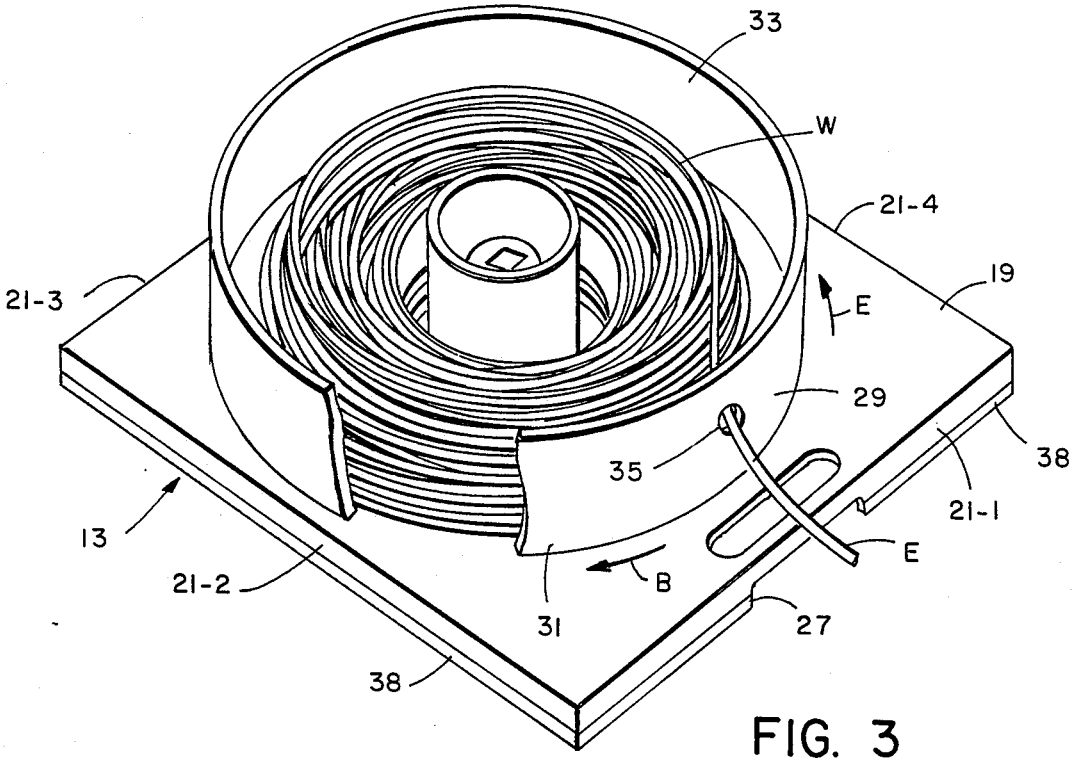
FIG. 3 is a perspective view partly broken away of the device shown in FIG. 1 with a coiled wire to be unwound seated on the device.

Referring now to FIG. 3, the manner in which device 11 is operated from the purpose of assisting in the unwinding of coil wire W is hereinafter described. First, wire W is placed on top surface 37-1 of disc shaped portion 37 so as to encircle wire guide 43. Next, an end E of wire W is inserted through hole 35. As wire W is pulled through hole 38, coil holder 15 will rotate on base 13 in a clockwise direction as indicated by arrows B. The rotational movement of coil holder 15 coupled with the tension applied to wire W by the user causes the continued unwinding of wire W.

Figure 4:
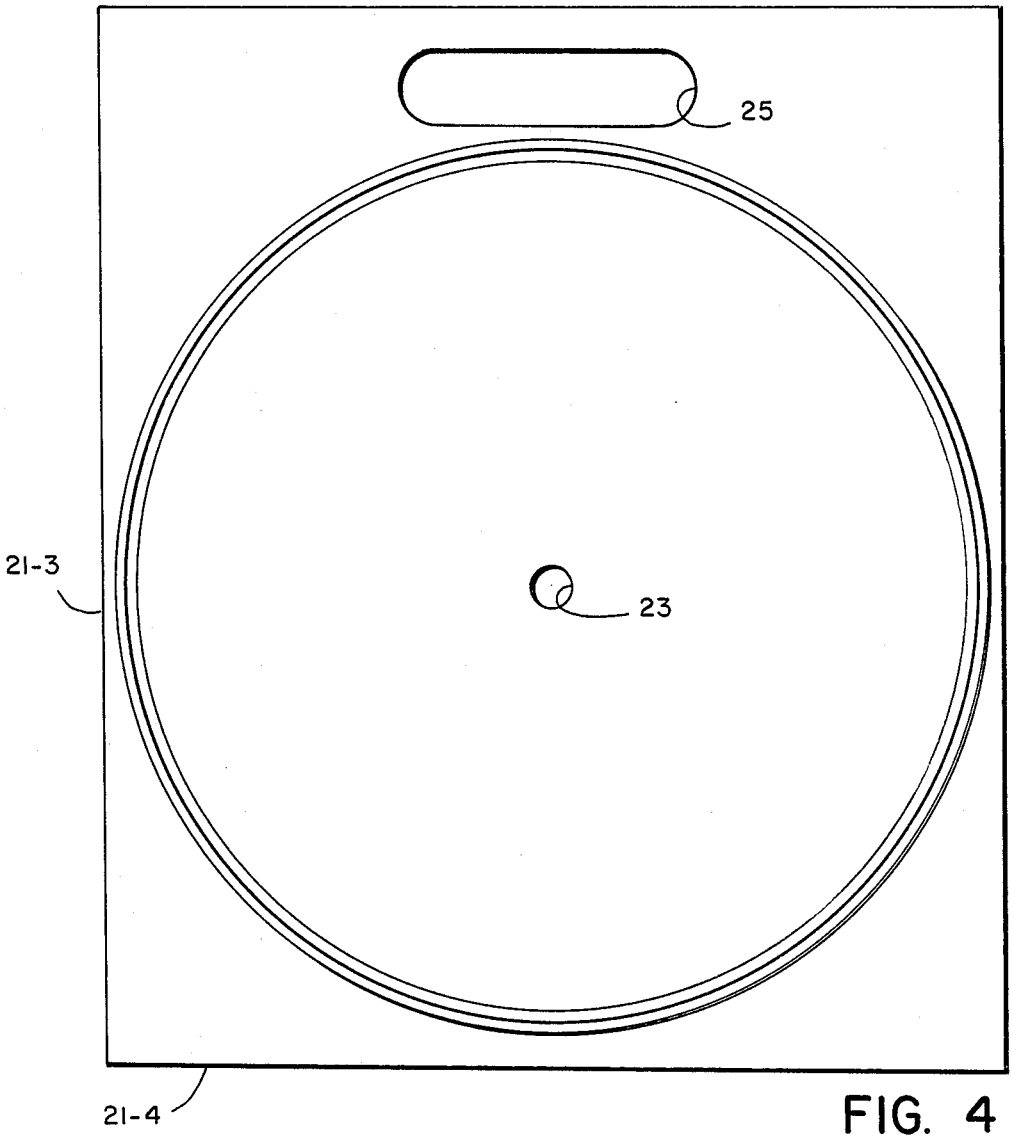
FIG. 4 is a plan view taken from the top of the base shown in the device in FIG. 1.
Figure 1A:
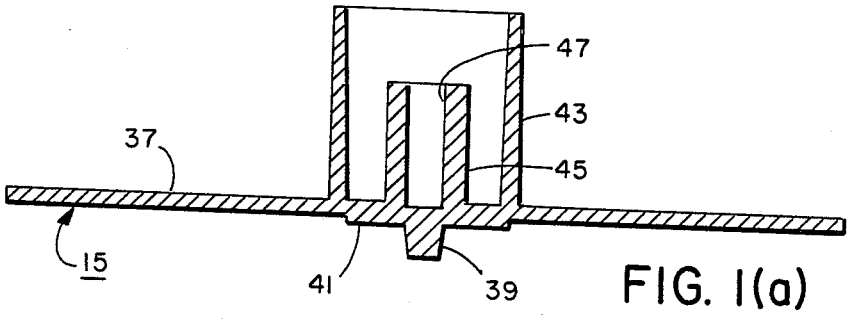
Figure 1B:
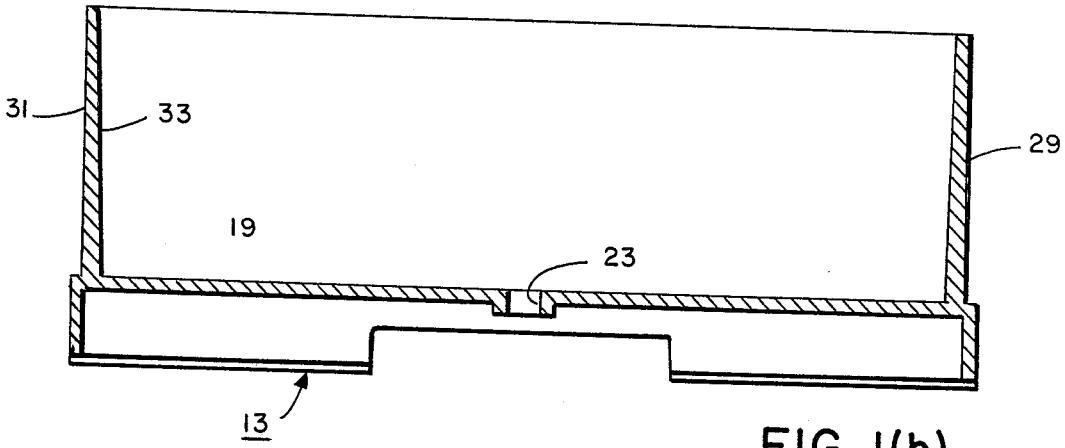
Figure 2:
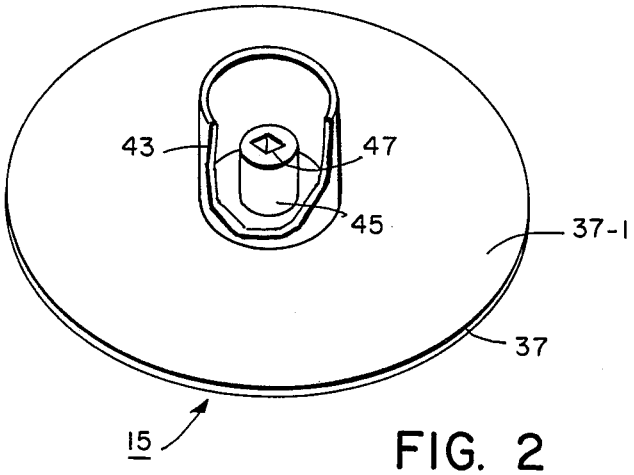
FIG. 2 is a perspective view taken from the top and partly broken away of the coil holder in the device shown in FIG. 1.

Referring now to FIGS. 4 and 5, the manner in which device 11 is used to assist a person in the re-winding of partially unwound coil wire W is hereinafter described. First, a crank re-winder 51, see FIG. 6., is inserted into square hole 43 of coil holder 15 as shown in FIG. 7. Crank re-winder 51, which may be made of metal, plastic, or other suitable material, is a unitary structure having a handle 53 and a stem 55. Stem 55 is sized and shaped so as to engage coil holder 15 when inserted into square hole 43. By inserting stem 55 into coil holder 15 and applying force on handle 53 in a counter-clockwise direction as indicated by arrow E, coil holder 15 will rotate in a counter-clockwise direction, causing wire W to become wound (i.e., re-wrapped) around wire guide 45. The embodiment of the present invention is intended to be merely exemplary and those skilled in the art shall be able to make numerous variations and modifications to it without departing from the spirit of the present invention. For example, a bearing may be inserted between the base and the coil holder to further minimize the friction between these two parts. All such variations and modifications are intended to be within the scope of the present invention as defined in the appended claims.

What is claimed is:

1. A device for use in assisting a person to unwind or re-wind coiled wire comprising:

(a) a base adapted to rest on a horizontal surface, said base having;

(i) a disc hole, circular in shape, having a diameter $d_1$, (ii) a cylindrical wall, disposed concentrically about said disc hole, said cylindrical wall having a diameter $d_2$ wherein $d_2$ is several times greater than $d_1$; and (b) a coil holder rotatably mounted on said base, said coil holder having:

(i) a disc sized and shaped to accommodate the coiled wire, said disc having a top surface, a bottom surface, and a diameter $d_3$ wherein $d_3$ is greater than $d_1$ but is less than $d_2$ by no more than ¼ inch.

(ii) a boss centrally disposed on said bottom surface of said disc for elevating said disc relative to said base, (iii) a cylindrical axle for insertion into said disc hole. said axle being centrally disposed on said boss and having a diameter $d_4$ wherein $d_4$ is slightly smaller than $d_1$.

2. The device as recited in claim 1 and wherein said coil holder has a square hole centrally disposed on said top surface of said disc and wherein said device further comprises a crank rewinder having a base shaped and sized to fit in said square hole for the purpose of causing the rotation of said disc in the direction causing the re-winding of the coiled wire.

3. The device as recited in claim 1 and wherein said coil holder has a second boss centrally disposed on said top surface of said disc, said second boss having a square hole centrally located and wherein said device further comprises a crank re-winder having a base shaped and sized to fit in said square hole for the purpose of causing the rotation of said disc in the direction causing the re-winding of the coiled wire.

4. The device as recited in claims 2 or 3, further comprising a rubber gripping strip affixed to the bottom of said base for the purpose of preventing the movement of said base when said device is in use.

* * * * *